US006210189B1

(12) United States Patent
Gantt

(10) Patent No.: US 6,210,189 B1
(45) Date of Patent: Apr. 3, 2001

(54) RIGID CHRISTMAS LIGHT INSTALLATION SYSTEM

(76) Inventor: Harold T. Gantt, 920 Mill Dr., Savannah, GA (US) 31419

( * ) Notice: Subject to any disclaimer, the term of this patent is extended or adjusted under 35 U.S.C. 154(b) by 0 days.

(21) Appl. No.: 09/124,737

(22) Filed: Jul. 30, 1998

(51) Int. Cl.[7] ..... H01R 4/60
(52) U.S. Cl. ..... 439/214; 362/410; 362/123
(58) Field of Search ..... 439/639, 638, 439/124, 218, 641, 653, 214, 216, 120, 647; 362/219, 249, 226

(56) References Cited

U.S. PATENT DOCUMENTS 2,414,866 * 1/1947 Glaser ..... 362/410
2,520,243 * 8/1950 Hoffman ..... 40/576
2,611,800 * 9/1952 Naughton ..... 439/216
2,722,777 * 11/1955 Simpson ..... 40/425
3,840,842 * 10/1974 Gabryelewicz ..... 439/639
5,550,720 * 8/1996 Carroll ..... 362/123
5,658,158 * 8/1997 Milan ..... 439/214
5,683,172 * 11/1997 Huag ..... 362/252
5,758,948 * 6/1998 Hale ..... 362/123
5,772,311 * 6/1998 Williams et al. ..... 362/238

* cited by examiner

*Primary Examiner*—Bruce Sircus
*Assistant Examiner*—Michael C. Zarroli

(57) ABSTRACT

A Christmas light system is provided including a plurality of rigid housings each having a couple mounted on each end thereof and a side face with a plurality of sockets mounted thereon for accepting a bulb therein. The sockets are each connected between the couples for providing electrical communication therebetween. The housings may be releasably coupled end-to-end in fixed relationship for providing electrical communication therebetween.

2 Claims, 3 Drawing Sheets

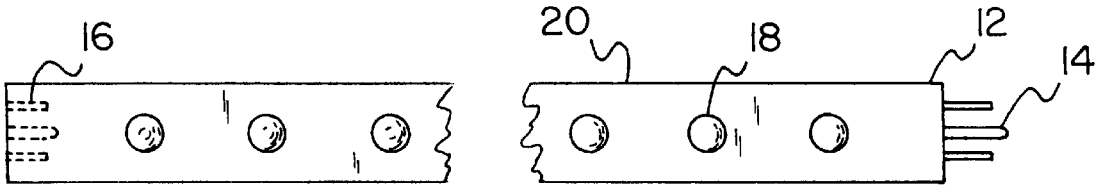
FIG. 3
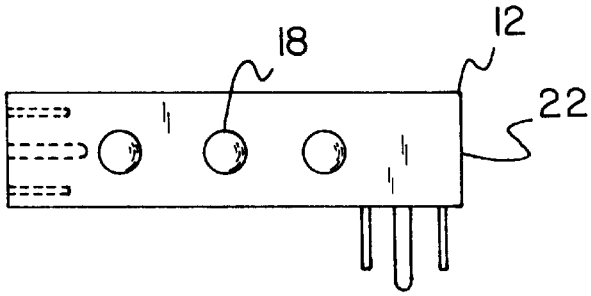
FIG. 4
FIG. 5
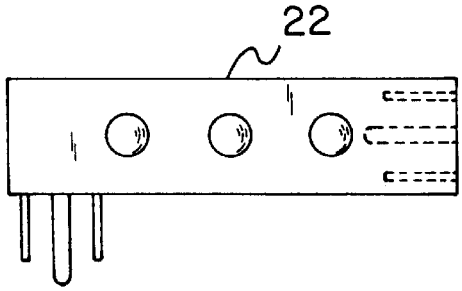
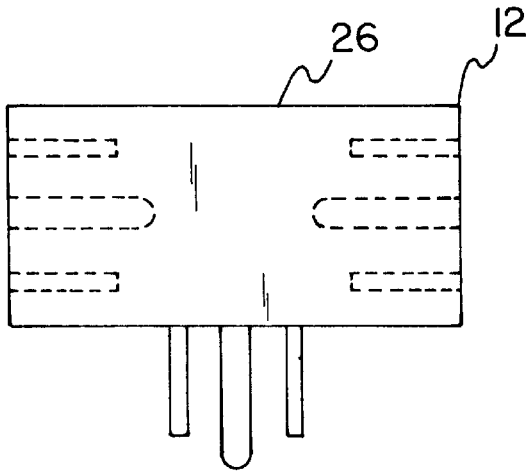
FIG. 6

RIGID CHRISTMAS LIGHT INSTALLATION SYSTEM

BACKGROUND OF THE INVENTION

1. Field of the Invention

The present invention relates to Christmas lights and more particularly pertains to a new rigid Christmas light installation system for conveniently installing Christmas lights on a structure such as a home.

2. Description of the Prior Art

The use of Christmas lights is known in the prior art. More specifically, Christmas lights heretofore devised and utilized are known to consist basically of familiar, expected and obvious structural configurations, notwithstanding the myriad of designs encompassed by the crowded prior art which have been developed for the fulfillment of countless objectives and requirements.

Known prior art Christmas lights include U.S. Pat. No. 5,094,632; U.S. Pat. No. 5,345,147; U.S. Pat. No. 4,005,923; U.S. Pat. No. 1,728,938; U.S. Pat. No. 3,344,392; U.S. Pat. No. 1,728,938; U.S. Pat. No. 3,344,392; and Foreign Patents WO 80/01746 and 0 534 021 A1.

In these respects, the rigid Christmas light installation system according to the present invention substantially departs from the conventional concepts and designs of the prior art, and in so doing provides an apparatus primarily developed for the purpose of conveniently installing Christmas lights on a structure such as a home.

SUMMARY OF THE INVENTION

In view of the foregoing disadvantages inherent in the known types of Christmas lights now present in the prior art, the present invention provides a new rigid Christmas light installation system construction wherein the same can be utilized for conveniently installing Christmas lights on a structure such as a home.

The general purpose of the present invention, which will be described subsequently in greater detail, is to provide a new rigid Christmas light installation system apparatus and method which has many of the advantages of the Christmas lights mentioned heretofore and many novel features that result in a new rigid Christmas light installation system which is not anticipated, rendered obvious, suggested, or even implied by any of the prior art Christmas lights, either alone or in any combination thereof.

To attain this, the present invention generally comprises a plurality of rigid housings each having a constant square cross-section along an entire length thereof. Each housing includes a first end with a plurality of male coupling strips extending therefrom. A second end of each housing is equipped with a plurality of female coupling slots formed therein. As shown in the Figures, a side face of each housing has a plurality of sockets mounted thereon in linear alignment for releasably accepting a bulb therein. The sockets are each connected between the coupling strips and the coupling slots for providing electrical communication therebetween. In use, the housings may be releasably coupled end-to-end in fixed relationship for providing electrical communication therebetween. Next provided is a plug housing including a pair of ends each with a plurality of female coupling slots formed therein. As shown in FIG. 6, a plurality of male coupling strips extend from a central extent of the plug housing. It should be noted that the male coupling strips remain in communication between the female coupling slots of the plug housing. As such, power is supplied thereto upon the male coupling strips of the plug housing being plugged into a conventional current receptacle. Finally, a timer mechanism includes a first end with a plurality of male coupling strips extending therefrom and a second end with a plurality of female coupling slots formed therein. In use, the timer mechanism is connected between the plug housing and the remaining housings. The timer mechanism serves to allow the supply of power to the bulbs only during intervals of selected duration at selected times. Further, the timer mechanism allows selective flashing of the bulbs when power is received.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new rigid Christmas light installation system apparatus and method which has many of the advantages of the Christmas lights mentioned heretofore and many novel features that result in a new rigid Christmas light installation system which is not anticipated, rendered obvious, suggested, or even implied by any of the prior art Christmas lights, either alone or in any combination thereof.

It is another object of the present invention to provide a new rigid Christmas light installation system which may be easily and efficiently manufactured and marketed.

It is a further object of the present invention to provide a new rigid Christmas light installation system which is of a durable and reliable construction.

An even further object of the present invention is to provide a new rigid Christmas light installation system which is susceptible to a low cost of manufacture with regard to both materials and labor, and which accordingly is then susceptible to low prices of sale to the consuming public, thereby making such rigid Christmas light installation system economically available to the buying public.

Still yet another object of the present invention is to provide a new rigid Christmas light installation system which provides in the apparatuses and methods of the prior art some of the advantages thereof, while simultaneously overcoming some of the disadvantages normally associated therewith.

Still another object of the present invention is to provide a new rigid Christmas light installation system for conveniently installing Christmas lights on a structure such as a home.

Even still another object of the present invention is to provide a new rigid Christmas light installation system that includes a plurality of rigid housings each having a couple mounted on each end thereof and a side face with a plurality of sockets mounted thereon for accepting a bulb therein. The sockets are each connected between the couples for providing electrical communication therebetween. The housings may be releasably coupled end-to-end in fixed relationship for providing electrical communication therebetween.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side view of the elongated hosing of the present invention.

FIGS. 4 & 5 are side views of the corner housings of the present invention.

FIG. 6 is a side view of the plug housing of the present invention.

DESCRIPTION OF THE PREFERRED EMBODIMENT

Figure 1:
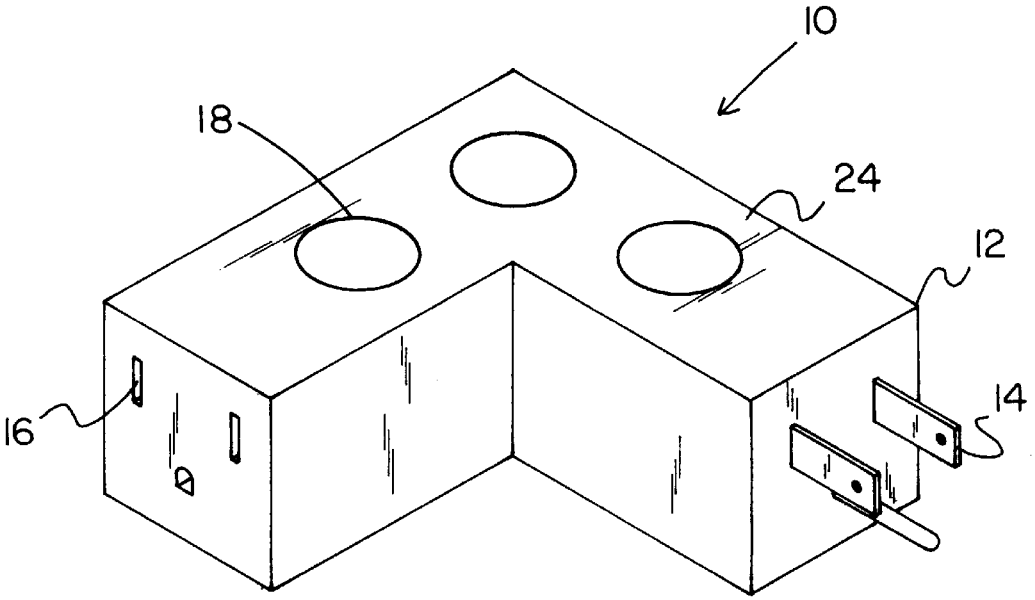
FIG. 1 is a perspective view of the elbow housing of the present invention.
Figure 2:
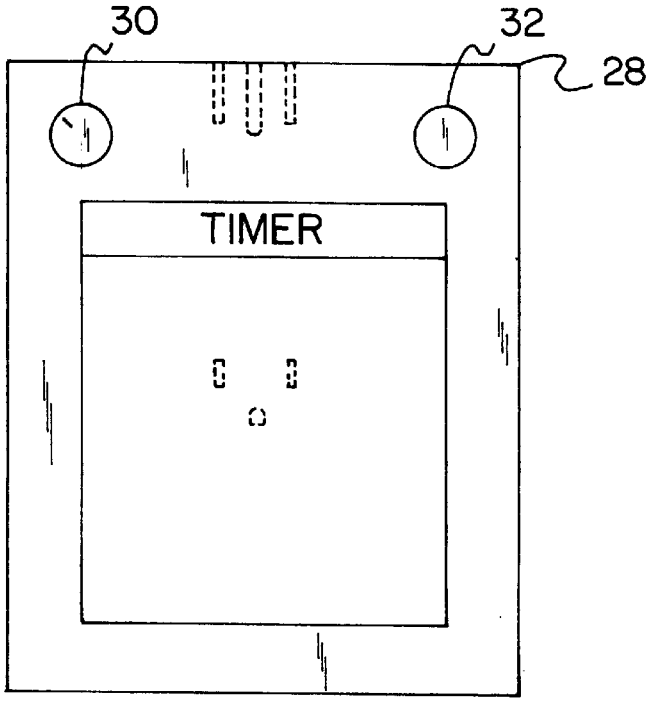
FIG. 2 is an illustration of the timer mechanism of the present invention.
Figure 7:
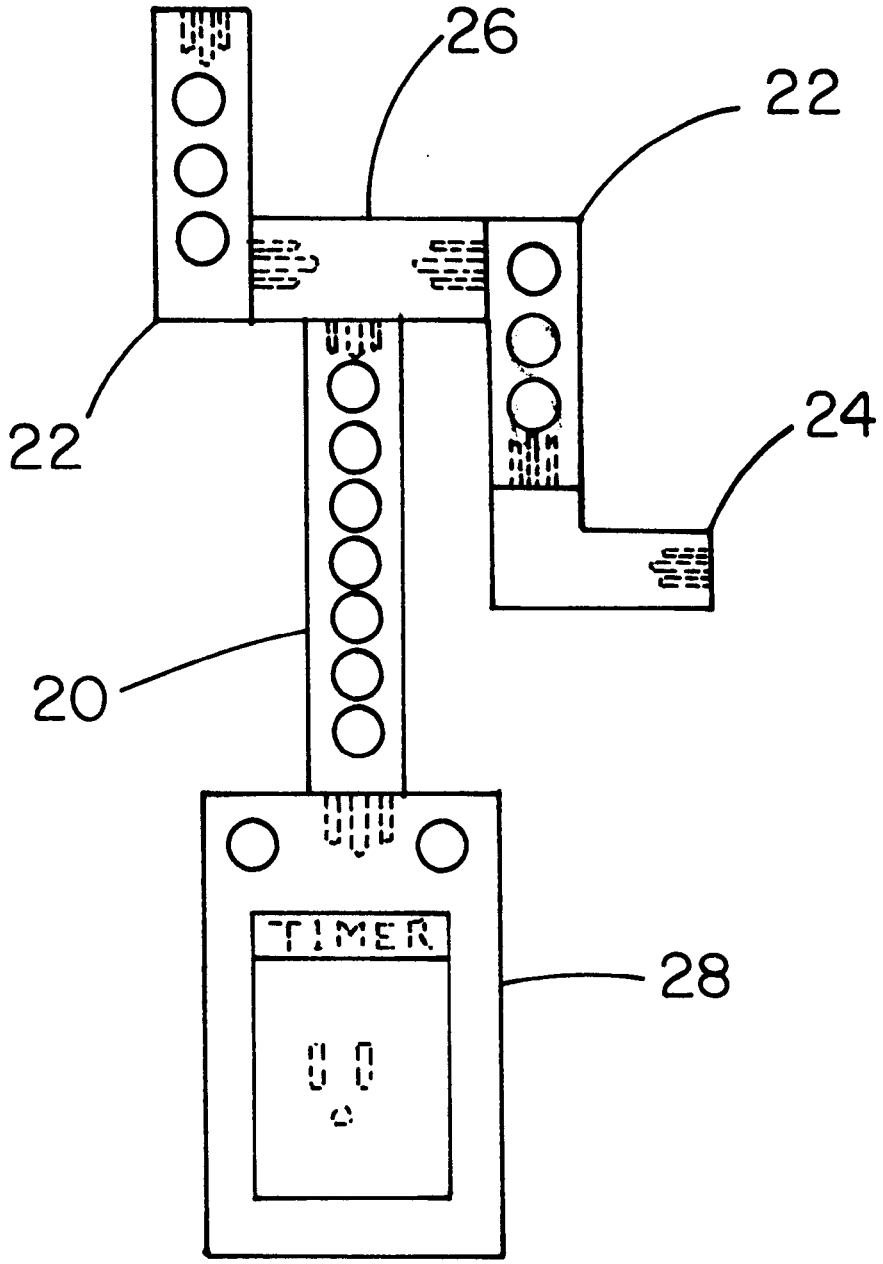
FIG. 7 is an assembled view of the entire invention.

With reference now to the drawings, and in particular to FIGS. 1 through 6 thereof, a new rigid Christmas light installation system embodying the principles and concepts of the present invention and generally designated by the reference numeral 10 will be described.

The present invention, designated as numeral 10, includes a plurality of rigid housings 12 each having a constant square cross-section along an entire length thereof. Each housing includes a first end with a plurality of male coupling strips 14 extending therefrom. A second end of each housing is equipped with a plurality of female coupling slots 16 formed therein As shown in the Figures, a side face of each housing has a plurality of sockets 18 mounted thereon in linear alignment each for releasably accepting a bulb therein. The sockets are each connected between the coupling strips and the coupling slots for providing electrical communication therebetween. In use, the housings may be releasably coupled end-to-end in fixed relationship for providing electrical communication therebetween. As such, a rigid structure is afforded which is mounted on a structure such as a house. This may be accomplished by way of any commonly known mounting bracket.

FIG. 3 shows one of a plurality of elongated intermediate housings 20. Such intermediate housings each are linear along an entire length thereof. The coupling strips and the coupling slots of each intermediate housing are situated about axes which remain in parallel with that associated with the intermediate housing.

With reference now to FIGS. 4 & 5, a plurality of short corner housings 22 are provided each being linear along an entire length thereof. Either the coupling strips or the coupling slots of each corner housing are situated about axes which remain in parallel with that associated with the corner housing. Further, the coupling strips or the coupling slots which are not parallel with the corner housing are situated about axes which remain perpendicular with that associated with the corner housing.

Lastly, the rigid housings include a plurality of elbow housings 24 each having a pair of linear extents situated in fixed perpendicular relationship. The coupling strips and coupling slots of each elbow housing are situated about axes which remain in parallel with that associated with the corresponding extent of the elbow housing. It should be noted that the elbow housings preferably do not have sockets formed therein. By the inclusion of housings of such varied structure, the present invention affords a versatile system which may be mounted on any one of various homes or the like.

Next provided is a plug housing 26 including a pair of ends each with a plurality of female coupling slots formed therein, unlike the foregoing housings. As shown in FIG. 6, a plurality of male coupling strips extend from a central extent of the plug housing. It should be noted that the male coupling strips remain in communication with the female coupling slots of the plug housing. As such, power is supplied thereto upon the male coupling strips of the plug housing being plugged into a conventional current receptacle.

Finally, a timer mechanism 28 includes a first end with a plurality of male coupling strips extending therefrom and a second end with a plurality of female coupling. In use, the timer mechanism is connected between the plug housing and the remaining housings. The timer mechanism serves to allow the supply of power to the bulbs only during intervals of selected duration at selected times. This may be accomplished by way of a dial or a digital display and key pad. Further, the timer mechanism allows selective flashing of the bulbs when power is received. In the preferred embodiment, a push button 30 is used to initiate a mode in which the bulbs are flashed. It should be noted that the flashing of the bulbs may be accomplished by the inclusion of a switch bulb within the circuit. The switch bulb is included in the circuit by way of the push button to intermittently cut power off to the remaining bulbs. Yet another option that may be incorporated with the timer mechanism is a fuse 32 for protection purposes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A Christmas light system comprising, in combination:

a plurality of rigid housings having a constant square cross-section along an entire length thereof, each housing including a first end with a plurality of male coupling strips extending therefrom, a second end with a plurality of female coupling slots formed therein, and a side face with a plurality of sockets mounted thereon in linear alignment for releasably accepting a bulb therein, wherein the sockets are each connected between the coupling strips and the coupling slots for providing electrical communication therebetween, whereby the housings may be releasably coupled end-to-end in fixed relationship for providing electrical communication therebetween, the rigid housings including:

a plurality of elongated intermediate housings each being linear along an entire length thereof, wherein the coupling strips and the coupling slots of each intermediate housing are situated about axes which remain in parallel with that associated with the intermediate housing, a plurality of corner housings each being linear along an entire length thereof, wherein at least one of the coupling strips and the coupling slots of each corner housing are situated about axes which remain in parallel with that associated with the corner housing and at least one of the coupling strips and the coupling slots of each corner housing are situated about axes which remain perpendicular with that associated with the corner housing, and a plurality of elbow housings each having a pair of linear extents situated in fixed perpendicular relationship, wherein the coupling strips and coupling slots of each elbow housing are situated about axes which remain in parallel with that associated with the corresponding extent of the elbow housing;

a plug housing including a pair of ends each with a plurality of female coupling slots formed therein and a plurality of male coupling strips extending from a central extent of the plug housing and in communication between the female coupling slots of the plug housing such that power is supplied thereto upon the male coupling strips of the plug housing being plugged into a conventional current receptacle, whereby the housings may be interconnected and mounted to a structure such that the bulbs are illuminated; and a timer mechanism including a first end with a plurality of male coupling strips extending therefrom and a second end with a plurality of female coupling slots formed therein, wherein the timer mechanism is connected between the plug housing and the remaining housings, the timer mechanism adapted to allow the supply of power to the bulbs only during intervals of selected duration at selected times, the timer mechanism further adapted to allow selective flashing of the bulbs when power is received.

2. A Christmas light system comprising:

a plurality of rigid housings, each of the rigid housings having a pair of ends, each end of the rigid housings including coupling means for removably coupling each of the rigid housings to another of the rigid housings in a physical and electrical manner;

wherein the coupling means comprises an electrical socket connector on a first end of each rigid housing and an electrical plug connector on a second end of each rigid housing, a portion of the electrical plug connector on the second end of one of the rigid housings being removably insertable into the electrical socket connector on the first end of another of the rigid housings to create a physical and electrical connection between rigid housings;

wherein each of the rigid housings has a side face with a plurality of sockets mounted thereon for accepting a bulb therein, wherein the sockets are each electrically connected between the electrical socket connector and the electrical plug connector of the coupling means of the rigid housing for providing electrical communication therebetween; and wherein the plurality of rigid housings includes at least one elbow housing having first and second portions, the first and second portions being oriented substantially perpendicularly to each other such that the electrical socket connector on the first end is oriented substantially perpendicular to the electrical plug connector on the second end;

a timer mechanism being adapted for connecting to one of the rigid housings and a power source for causing selective interruption of power to the rigid housing at selected times for producing selective flashing of blubs mounted on the rigid housing;

wherein the electrical plug connector of the coupling means includes a pair of prong strips extending from the second end of the rigid housing, and wherein the electrical socket connector of the coupling means includes a pair of coupling slots extending into the first end of the rigid housing, the prong strips and coupling slots being adapted such that the prong strips are removably insertable into the coupling slots for connecting the first end of a first one of the rigid housings to a second end of a second one of the rigid housings;

wherein each rigid housing has a uniform cross-section along a length of the housing between the first and second ends;

wherein the rigid housings include elongated intermediate housings having a substantially linear configuration and a plurality of elbow housings;

wherein one of the rigid housing is linear between the first and second ends with a longitudinal axis between the ends, and wherein the electrical plug connector of the coupling means includes a pair of prong strips extending from the second end of the rigid housing, the prong strips extending substantially perpendicular to the longitudinal axis of the rigid housing; and wherein the electrical plug connector of the coupling means includes a pair of prong strips extending from the second end of the rigid housing, and wherein on one of the rigid housings the prong strips extend substantially parallel to a portion of the rigid housing adjacent to the second end of the rigid housing.

* * * * *